US008847714B2

(12) United States Patent
Uchida

(10) Patent No.: US 8,847,714 B2
(45) Date of Patent: Sep. 30, 2014

(54) RELAY

(71) Applicant: Anden Co., Ltd., Anjo (JP)

(72) Inventor: Akikazu Uchida, Obu (JP)

(73) Assignee: Arden Co., Ltd., Anjo (JP)

( * ) Notice: Subject to any disclaimer, the term of this patent is extended or adjusted under 35 U.S.C. 154(b) by 0 days.

(21) Appl. No.: 14/050,541

(22) Filed: Oct. 10, 2013

(65) Prior Publication Data

US 2014/0035705 A1 Feb. 6, 2014

Related U.S. Application Data

(62) Division of application No. 13/547,116, filed on Jul. 12, 2012, now Pat. No. 8,698,582.

(30) Foreign Application Priority Data

Jul. 18, 2011 (JP) ..... 2011-157314

(51) Int. Cl.

| | |
|---|---|
| ***H01H 67/02*** | (2006.01) |
| ***H01H 51/06*** | (2006.01) |
| ***H01H 50/54*** | (2006.01) |
| ***H01H 1/54*** | (2006.01) |
| *H01H 9/44* | (2006.01) |

(52) U.S. Cl.

CPC ..... *H01H 51/06* (2013.01); *H01H 51/065* (2013.01); *H01H 50/546* (2013.01); *H01H 1/54* (2013.01); *H01H 9/443* (2013.01)

USPC ..... 335/131; 335/132

(58) Field of Classification Search

USPC ..... 335/131

See application file for complete search history.

(56) References Cited

U.S. PATENT DOCUMENTS

| | | | | |
|---|---|---|---|---|
| 3,194,920 | A | | 7/1965 | Scheib, Jr. |
| 3,388,353 | A | | 6/1968 | Isler |
| 4,117,428 | A | | 9/1978 | Streich et al. |
| 4,371,855 | A | | 2/1983 | Lenzing |
| 4,467,301 | A | * | 8/1984 | Goodrich ..... 335/195 |
| 4,550,299 | A | | 10/1985 | Bachler |
| 5,373,273 | A | | 12/1994 | Guery et al. |
| 5,546,061 | A | | 8/1996 | Okabayashi et al. |
| 5,933,065 | A | | 8/1999 | Duchemin |
| 5,989,528 | A | | 11/1999 | Tanner et al. |

(Continued)

FOREIGN PATENT DOCUMENTS

JP 2012-256482 A 12/2012

*Primary Examiner* — Shawki S Ismail
*Assistant Examiner* — Lisa Homza
(74) *Attorney, Agent, or Firm* — Posz Law Group, PLC

(57) ABSTRACT

A relay includes two stators and a movable element. Each stator has a fixed contact and includes an excitation portion that has a winding shape and generates a magnetic field. The movable element has movable contacts. In a magnetic flux of the magnetic field generated by the excitation portion, a movable element passing magnetic flux that passes through the movable element is orthogonal to a direction of current flowing in the movable element and a moving direction of the movable element. A Lorentz force that is generated by the movable element passing magnetic flux and the current flowing in the movable element acts in a direction for bringing the movable contacts into contact with the fixed contacts.

6 Claims, 15 Drawing Sheets

(56) References Cited

U.S. PATENT DOCUMENTS

| | | | | |
|---|---|---|---|---|
| 6,150,909 | A | 11/2000 | Meier | |
| 6,700,466 | B1 | 3/2004 | Yamamoto et al. | |
| 7,049,912 | B2 | 5/2006 | Bataille et al. | |
| 7,420,446 | B2 * | 9/2008 | Fushimi et al. | 335/6 |
| 7,902,948 | B2 * | 3/2011 | Luders | 335/201 |
| 8,159,319 | B2 | 4/2012 | Ferree | |
| 2011/0241809 | A1 | 10/2011 | Sugisawa et al. | |
| 2013/0021121 | A1 | 1/2013 | Uchida | |

* cited by examiner

RELAY

CROSS REFERENCE TO RELATED APPLICATIONS

The present application is a divisional of application Ser. No. 13/547,116 filed on Jul. 12, 2012 which is based on and claims priority to Japanese Patent Application No. 2011-157314 filed on Jul. 18, 2011, the contents of which are incorporated in their entirety herein by reference.

TECHNICAL FIELD

The present disclosure relates to a relay for opening and closing an electric circuit.

BACKGROUND

In a conventional relay, stators having fixed contacts are positioned, and a movable element having movable contacts is moved. An electric circuit is closed by bringing the movable contacts into contact with the fixed contacts. The electric circuit is opened by separating the movable contacts from the fixed contacts. More specifically, the conventional relay includes a movable member attracted by an electromagnetic force of a coil, a contact pressure spring for biasing the movable element in a direction for bringing the movable contacts into contact with the fixed contacts, and a return spring for biasing the movable element through the movable member in a direction for separating the movable contacts from the fixed contacts.

If the coil is energized, the movable member is driven in a direction for separating from the movable element by the electromagnetic force. The movable element is biased by the contact pressure spring to move so that movable contacts come into contact with the fixed contacts. Then, the movable member separates from the movable element (see, for example, Japanese Patent No. 3,321,963).

SUMMARY

It is an object of the present disclosure to provide a relay that can restrict separation between movable contacts and fixed contacts due to a contact portion electromagnetic repulsive force.

A relay according to an aspect of the present disclosure includes two stators and a movable element. Each of the stators has a fixed contact and includes an excitation portion that has a winding shape and generates a magnetic field. The movable element has movable contacts. The movable element is movable so that the movable contacts respectively come in contact with the fixed contacts to close an electric circuit and the movable contacts separates from the fixed contacts to open the electric circuit. In a magnetic flux of the magnetic field generated by the excitation portion, a movable element passing magnetic flux that passes through the movable element is orthogonal to a direction of current flowing in the movable element and a moving direction of the movable element. A Lorentz force that is generated by the movable element passing magnetic flux and the current flowing in the movable element acts in a direction for bringing the movable contacts into contact with the fixed contacts.

The above-described relay can restrict separation between the movable contacts and the fixed contacts even during a large-current energization.

BRIEF DESCRIPTION OF THE DRAWINGS

Additional objects and advantages of the present disclosure will be more readily apparent from the following detailed description when taken together with the accompanying drawings. In the drawings.

DETAILED DESCRIPTION

Figure 1:
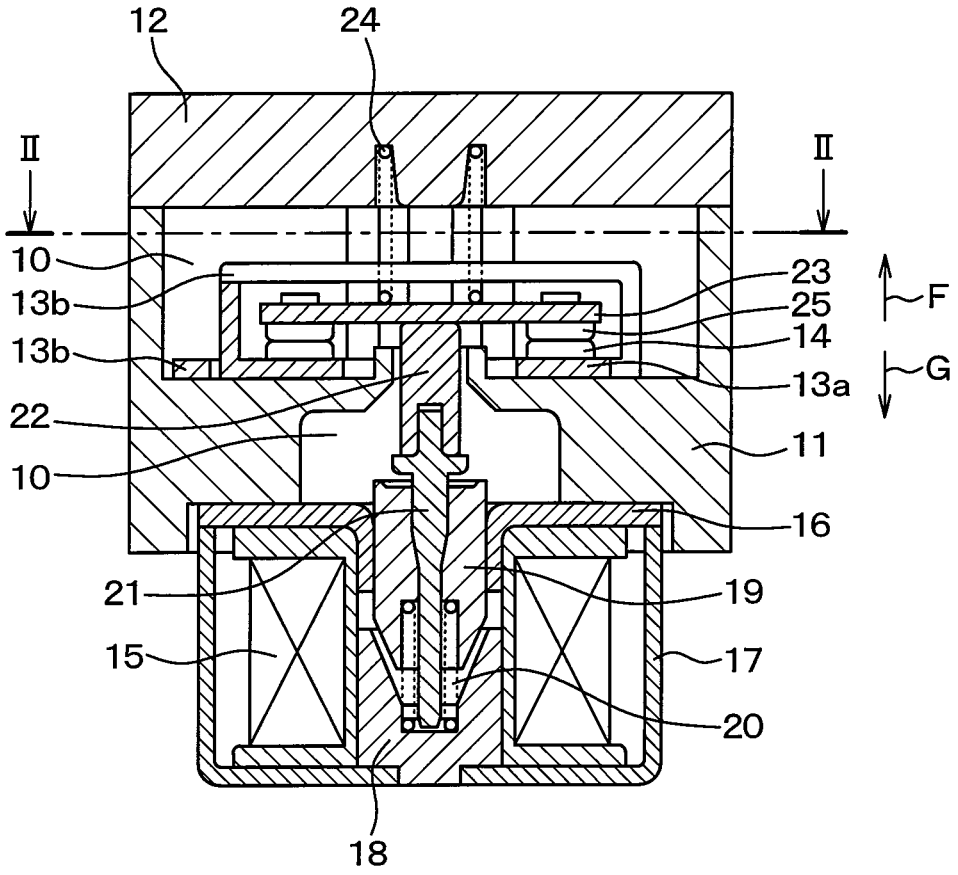
FIG. 1 is a cross-sectional view showing a relay according to a first embodiment of the present disclosure.

Before describing embodiments of the present disclosure, difficulties which the inventor of the present application found will be described below.

In a conventional relay, in contact portions of movable contacts and fixed contacts, a current inversely flows in regions where the movable contacts and the fixed contacts face each other. Accordingly, an electromagnetic repulsive force (hereinafter referred to as "contact portion electromagnetic repulsive force") is generated. The contact portion electromagnetic repulsive force acts to separate the movable contacts and the fixed contacts. Therefore, an elastic force of a contact pressure spring is set to restrict the separation between the movable contacts and the fixed contacts due to the electromagnetic repulsive force.

However, because the contact portion electromagnetic repulsive force increases with increase in the amount of current, the spring force of the contact pressure spring increases with increase in current value. Accordingly, a physical size of the contact pressure spring is increased, and furthermore a physical size of the relay is increased.

JP-A-2011-228245 (corresponding to US 2011/0241809 A1) discloses a relay in which separation between movable contacts and fixed contacts is restricted by a Lorentz force acting in a direction opposite to a contact portion electromagnetic repulsive force. Specifically, a magnet is disposed adjacent to the movable element, and the movable element is subject to the Lorentz force acting in the direction opposite to the contact portion electromagnetic repulsive force with the use of a current flowing into the movable element and a magnetic flux generated in the magnet.

The Lorentz force generated by the current and the magnetic flux is proportional to the current value and a magnetic flux density. However, in the above-described relay, because the contact portion electromagnetic repulsive force is proportional to a square of the current value, the movable contacts and the fixed contacts may separate from each other during large-current energization.

Hereinafter, embodiments of the present disclosure will be described with reference to the accompanying drawings. In the following respective embodiments, identical or equivalent portions are denoted by the same reference numerals or symbols.

First Embodiment

Figure 2:
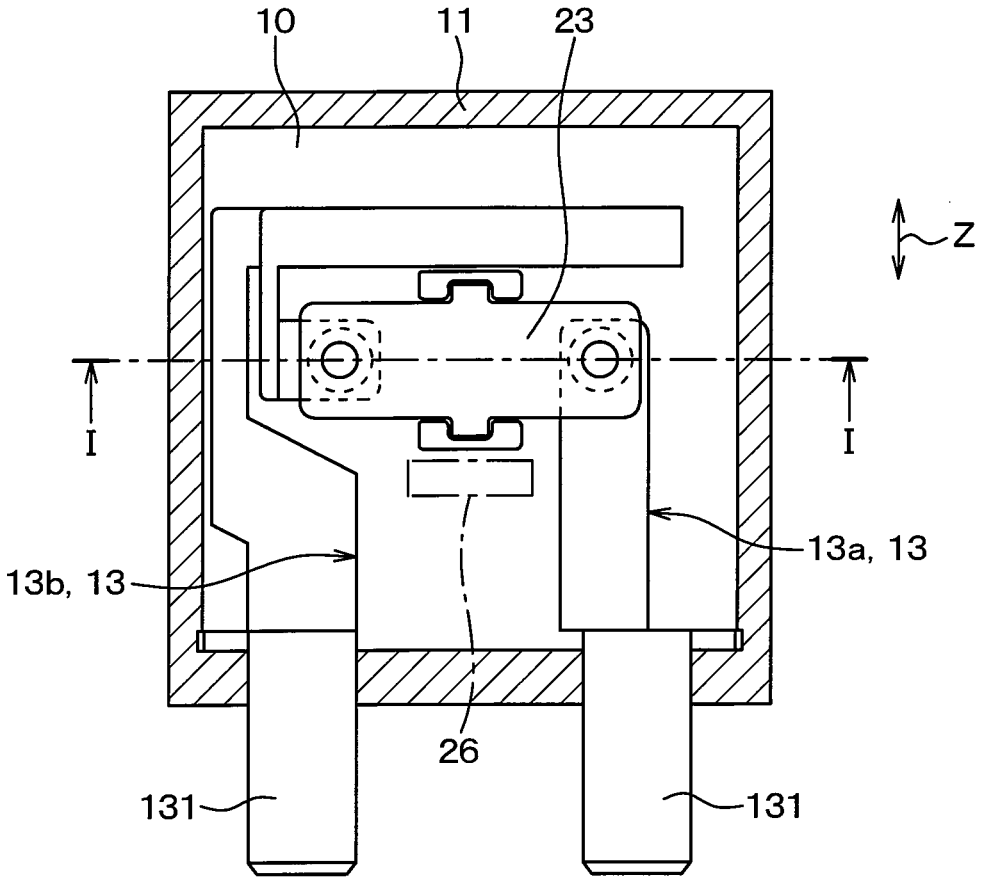
FIG. 2 is a cross-sectional view of the relay taken along a line II-II in FIG. 1.
Figure 3A:
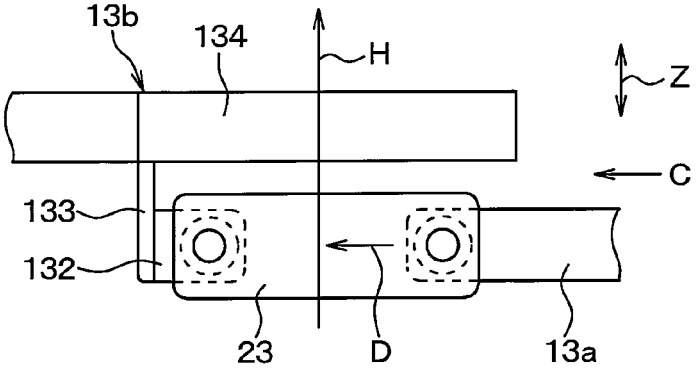
FIG. 3A is a plan view of a movable element and stators in the relay in FIG. 1.
Figure 3C:
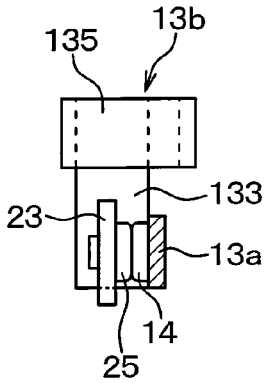
FIG. 3C is a fragmentary view of the movable element and the stators taken in the direction of an arrow C in FIG. 3A.
Figure 3B:
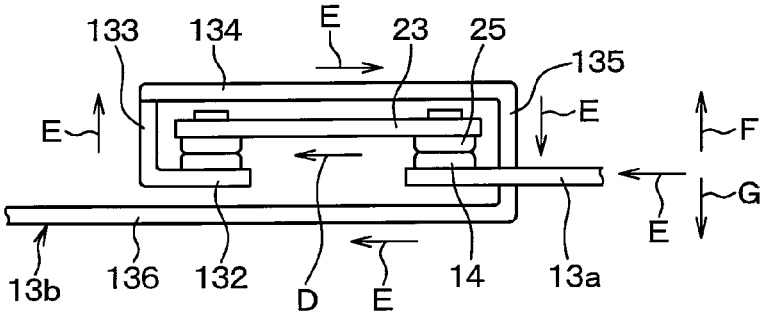
FIG. 3B is a front view of the movable element and the stators in FIG. 3A.

A first embodiment of the present disclosure will be described. FIG. 1 is a cross-sectional view showing a relay according to the first embodiment of the present disclosure, which corresponds to a cross-sectional view taken along a line I-I in FIG. 2. FIG. 2 is a cross-sectional view of the relay taken along a line II-II in FIG. 1. FIG. 3A is a plan view of a movable element 23 and stators 13 in the relay in FIG. 1, FIG. 3B is a front view of the movable element 23 and the stators 13 in FIG. 3A, and FIG. 3C is a fragmentary view of the movable element 23 and the stators 13 taken in the direction of an arrow C in FIG. 3A.

As shown in FIG. 1 and FIG. 2, the relay according to the present embodiment includes a base 11 and a cover 12. The base 11 is made of resin. The base 11 has an approximately rectangular parallel piped shape and defines a housing space 10 therein. The cover 12 is made of resin and is coupled to the base 11 so as to close an opening portion of the housing space 10 at one end of the base 11.

The base 11 is fixed with two stators 13 each formed of an electrically conductive metal plate. Each of the stators 13 has one end portion located within the housing space 10, and the other end protrudes toward an external space. In the following description, one of the stators 13 is called "first stator 13*a*" and the other is called "second stator 13*b*."

At end portions of the respective stators 13 within the housing space 10, fixed contacts 14 made of an electrically conductive metal are fixed by swaging. On an external space side of each of the stators 13, a load circuit terminal 131 coupled to an external harness (not shown) is disposed. The load circuit terminal 131 of the first stator 13*a* is coupled to a power supply (not shown) through the external harness, and the load circuit terminal 131 of the second stator 13*b* is coupled to an electric load (not shown) through an external harness.

A cylindrical coil 15 that generates an electromagnetic force during energization is coupled to the base 11 so as to cover an opening portion of the housing space 10 at the other end side thereof. The coil 15 is coupled to an ECU (not shown) through the external harness, and the coil 15 is energized through the external harness.

A flanged cylindrical plate 16 made of a magnetic metal material is arranged between the base 11 and the coil 15, and a yoke 17 made of a magnetic metal material is disposed on a side of the coil 15 opposite to the base 11 and an outer peripheral side of the coil 15. The plate 16 and the yoke 17 are fixed to the base 11.

A fixed core 18 made of a magnetic metal material is arranged in an inner peripheral space of the coil 15, and the fixed core 18 is held by the yoke 17.

A movable core 19 made of a magnetic metal is arranged at a position opposite to the fixed core 18 within the inner peripheral space of the coil 15. The movable core 19 is slidably held by the plate 16.

A return spring 20 that biases the movable core 19 toward an opposite side from the fixed core 18 is arranged between the fixed core 18 and the movable core 19. During the coil energization, the movable core 19 is attracted toward the fixed core 18 against the return spring 20.

The plate 16, the yoke 17, the fixed core 18, and the movable core 19 configure a magnetic path of the magnetic flux induced by the coil 15.

A shaft 21 made of metal penetrates the movable core 19 and is fixed to the movable core 19. One end of the shaft 21 extends toward the opposite side from the fixed core 18, and the end of the shaft 21 is fitted into an insulating glass 22 made of resin which provides excellent insulation. The movable core 19, the shaft 21, and the insulating glass 22 configure a movable member of the present disclosure.

A movable element 23 formed of an electrically conductive metal plate is disposed in the housing space 10. A contact pressure spring 24 that biases the movable element 23 toward the stators 13 is disposed between the movable element 23 and the cover 12.

Movable contacts 25 made of an electrically conductive metal are fixed by swaging on the movable element 23 at respective positions facing the fixed contacts 14. When the movable core 19 is driven toward the fixed core 18 by an electromagnetic force, the fixed contacts 14 and the movable contacts 25 come in contact with each other.

The detailed configuration and arrangement of the stators 13 and the movable element 23 will be described below with reference to FIG. 1 to FIG. 3C.

An arrow D in FIG. 3A and FIG. 3B indicates a flow of current in the movable element 23, and arrows E in FIG. 3 indicate a flow of current in the stators 13. Also, in the present specification, an aligning direction (right and left directions on a paper plane in FIG. 1 and FIG. 2) of the two movable contacts 25 is called "movable contact alignment direction." A moving direction (up and down directions on the paper plane in FIG. 1, and a vertical direction on the paper plane in FIG. 2) of the movable element 23 is called "movable element moving direction." A direction (up and down directions on the paper plane in FIG. 2) perpendicular to both of the movable contact alignment direction and the movable element moving direction is called "reference direction Z."

In the movable element moving direction, a direction (upward direction on the paper plane in FIG. 1) for separating the movable contacts 25 from the fixed contacts 14 is called "movable element opening direction F," and a direction (downward direction on the paper plane in FIG. 1) for bringing the movable contacts 25 into contact with the fixed contacts 14 is called "movable element closing direction G."

The movable element 23 is a slender rectangular parallel piped shape extending in the movable contact alignment direction.

The second stator 13*b* includes a fixed contact mounting plate 132 on which the fixed contact 14 is fixed. The fixed contact mounting plate 132 is positioned in the movable element closing direction G with respect to the movable element 23. In other words, the fixed contact mounting plate 132 is disposed to an opposite side of the movable element 25 from the movable element 23.

The second stator 13*b* includes an excitation portion that generates a magnetic field. The excitation portion includes a first plate 133, a second plate 134, a third plate 135, and a fourth plate 136. The first plate 133 extends from an end of the fixed contact mounting plate 132 along the movable element moving direction. The second plate 134 is positioned in the movable element opening direction F with respect to the movable element 23. In other words, the second plate 134 is disposed to an opposite side of the movable element 23 from the movable contact 25. The second plate 134 extends from an end of the first plate 133 in parallel to the movable element 23 (that is, the movable contact alignment direction). The third plate 135 extends from an end of the second plate 134 in the movable element moving direction. The fourth plate 136 is positioned in the movable element closing direction G with respect to the movable element 23, and extends from an end of the third plate 135 in parallel to the movable element 23. The first plate 133 and the third plate 135 are located outside of the movable contacts 25 and the fixed contacts 14 in the movable contact alignment direction.

The excitation portion configured by the first plate 133 to the fourth plate 136 has a winding shape as explicitly shown in FIG. 3B, and therefore a magnetic field is generated around the excitation portion when a current flows in the excitation portion.

A direction of current flowing in the second plate 134 that is positioned in the movable element opening direction F with respect to the movable element 23 is opposite to a direction of current flowing in the movable element 23.

A direction of current flowing in the fourth plate 136 that is positioned in the movable element closing direction G with respect to the movable element 23 is the same as the direction of current flowing in the movable element 23.

The second plate 134 to the fourth plate 136, and the movable element 23 are arranged in a positional relationship so as to be displaced from each other in the reference direction Z, and so as not to overlap with each other when viewed along the movable element moving direction.

Subsequently, the operation of the relay according to present embodiment will be described. First, when the coil 15 is energized, the movable core 19, the shaft 21, and the insulating glass 22 are attracted toward the fixed core 18 against the return spring 20 due to the electromagnetic force. The movable element 23 is biased by the contact pressure spring 24, and moves with following the movable core 19. With this configuration, the movable contacts 25 come into contact with the facing fixed contacts 14, the two load circuit terminals 131 are electrically coupled to each other, and current flows into the load circuit terminals 131 through the movable element 23. After the movable contacts 25 have come into contact with the fixed contacts 14, the movable core 19 moves toward the fixed core 18, and the insulating glass 22 and the movable element 23 move away from each other.

When the load circuit terminals 131 are electrically coupled to each other, the electric field is generated around the excitation portion. A direction H of a movable element passing magnetic flux when the magnetic flux of the magnetic field generated by the excitation portion passes through the movable element 23 (refer to FIG. 3A) is orthogonal to the direction of current flowing in the movable element 23 and the moving direction of the movable element 23. In more detail, the direction H of the movable element passing magnetic flux is an upward direction on the paper plane in FIG. 3A.

The Lorentz force is generated by the movable element passing magnetic flux and the current flowing in the movable element 23. The Lorentz force allows the movable element 23 to be biased in a direction for bringing the movable contacts 25 into contact with the fixed contacts 14. The Lorentz force, which acts on the movable element 23, counteracts the contact portion electromagnetic repulsive force. Accordingly, separation between the movable contacts 25 and the fixed contacts 14 due to the contact portion electromagnetic repulsive force can be restricted.

On the other hand, when the energization to the coil 15 is blocked, the return spring 20 biases the movable core 19 and the movable element 23 toward an opposite side of the fixed core against the contact pressure spring 24. As a result, the movable contacts 25 moves away from the fixed contacts 14, and the two load circuit terminals 131 are decoupled from each other.

According to present embodiment, because the density of the movable element passing magnetic flux is proportional to the current value, the generated Lorentz force is proportional to a square of the current value. Accordingly, separation between the movable contacts 25 and the fixed contacts 14 due to the contact portion electromagnetic repulsive force can be restricted with certainty even during the large-current energization. As a result, the spring force of the contact pressure spring 24 can be set to be smaller, the contact pressure spring 24 can be downsized, and furthermore the relay can be downsized.

The second plate 134 and the movable element 23, which are located in the movable element opening direction with respect to the movable element 23, are arranged in the positional relationship so as to be displaced from each other in the reference direction Z, and so as not to overlap with each other when viewed along the movable element moving direction. Therefore, a space is provided in the movable element opening direction F with respect to the movable element 23, and the contact pressure spring 24 can be arranged in the space.

As indicated by a dashed line in FIG. 2, a permanent magnet 26 may be arranged adjacent to the movable element 23 so that a direction of the Lorentz force, which acts on the movable element 23 by the current flowing in the movable element 23 and the magnetic flux of the permanent magnet 26, acts in the direction for bringing the movable contacts 25 into contact with the fixed contacts 14. Accordingly, separation between the movable contacts 25 and the fixed contacts 14 due to the contact portion electromagnetic repulsive force can be restricted with certainty.

Second Embodiment

Figure 4A:
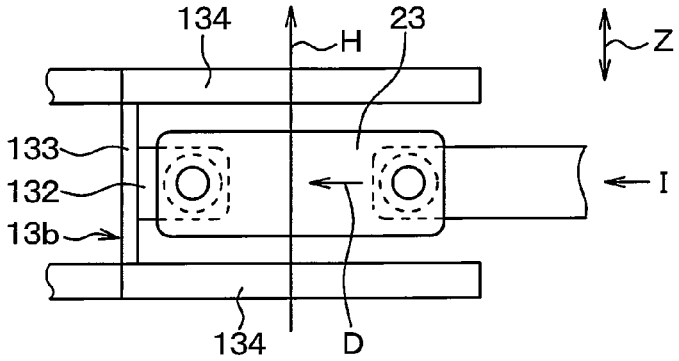
FIG. 4A is a plan view of a movable element and stators in a relay according to a second embodiment of the present disclosure.
Figure 4C:
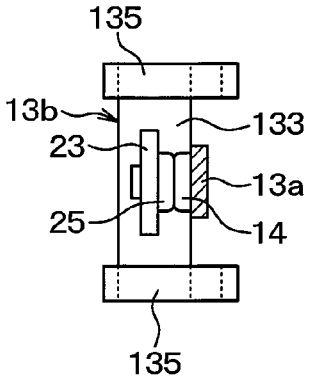
FIG. 4C is a fragmentary view of the movable element and the stators taken in the direction of an arrow I in FIG. 4A.
Figure 4B:
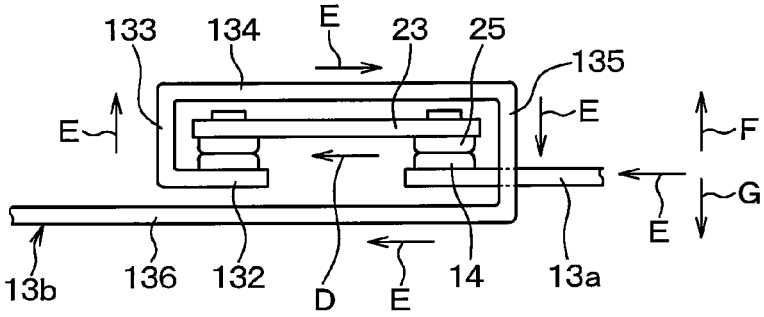
FIG. 4B is a front view of the movable element and the stators in FIG. 4A.

A second embodiment of the present disclosure will be described. FIG. 4A is a plan view of a movable element 23 and stators 13 in a relay according to the second embodiment of the present disclosure, FIG. 4B is a front view of the movable element 23 and the stators 13 in FIG. 4A, and FIG. 4C is a fragmentary view of the movable element 23 and the stators 13 taken in the direction of an arrow I in FIG. 4A. Hereinafter, only portions different from those in the first embodiment will be described.

As shown in FIG. 4A to FIG. 4C, the second stator 13*b* is divided into two pieces from one end of the fixed contact mounting plate 132, and provides two sets of the first plates 133 to the fourth plates 136. In other words, the second stator 13*b* has two excitation portions.

The two sets of the first plates 133 to the fourth plates 136 are arranged on either side of the movable element 23 when viewed along the movable element moving direction.

In present embodiment, because the movable element 23 is subjected to the Lorentz force from either side thereof, the posture of the movable element 23 is stabilized.

According to present embodiment, because the current flowing in the second stator 13*b* is divided into two by the two sets of the first plates 133 to the fourth plates 136, the respective cross-sectional areas of the first plates 133 to the fourth plates 136 can be reduced. Thus, a bending process in manufacturing the second stator 13*b* can be facilitated.

Third Embodiment

Figure 5A:
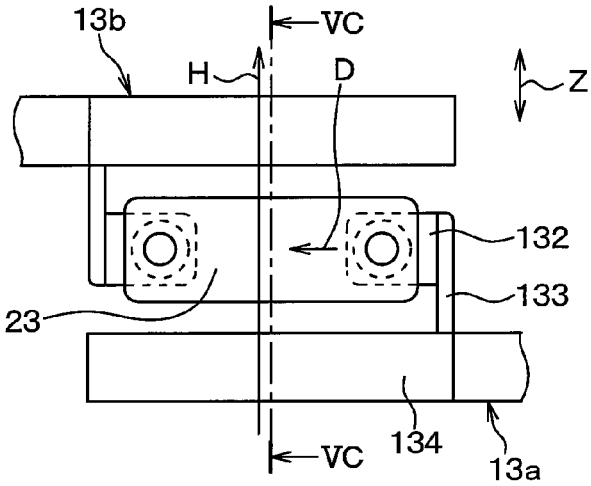
FIG. 5A is a plan view of a movable element and stators in a relay according to a third embodiment of the present disclosure.
Figure 5C:
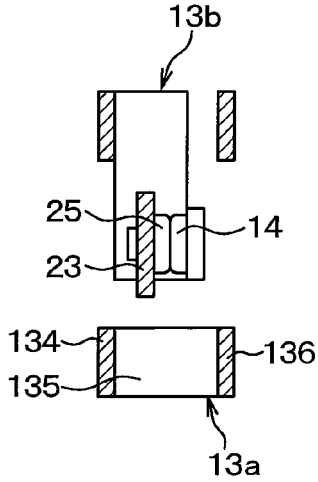
FIG. 5C is a cross-sectional view of the movable element and the stators taken along a line VC-VC in FIG. 5A.
Figure 5B:
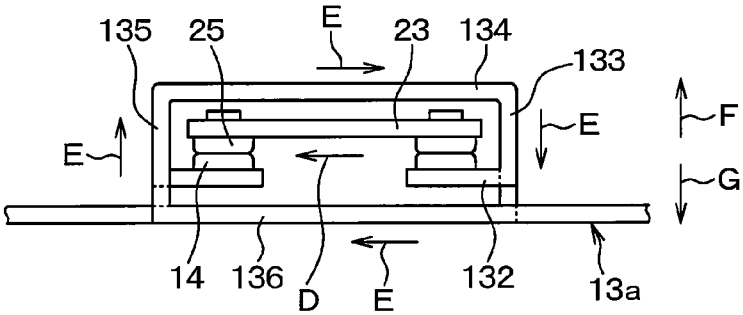
FIG. 5B is a front view of the movable element and the stators in FIG. 5A.

A third embodiment of the present disclosure will be described. FIG. 5A is a plan view showing a movable element 23 and stators 13 in a relay according to the third embodiment of the present disclosure, FIG. 5B is a front view of the movable element 23 and the stators 13 in FIG. 5A, and FIG. 5C is a cross-sectional view of the movable element 23 and the stators 13 taken along a line VC-VC in FIG. 5A. Hereinafter, only portions different from those in the first embodiment will be described.

As shown in FIG. 5A to FIG. 5C, the first stator 13*a* also has the same shape as that of the second stator 13*b* in the first embodiment.

That is, the first stator 13*a* includes the fixed contact mounting plate 132 on which the fixed contacts 14 are fixed. The fixed contact mounting plate 132 is positioned in the movable element closing direction G with respect to the movable element 23.

The first stator 13*a* includes the excitation portion that generates a magnetic field. The excitation portion includes the first plate 133, the second plate 134, the third plate 135, and the fourth plate 136. The first plate 133 extends from an end of the fixed contact mounting plate 132 along the movable element moving direction. The second plate 134 is positioned in the movable element opening direction F with respect the movable element 23 and extends from an end of the first plate 133 in parallel to the movable element 23. The third plate 135 extends from an end of the second plate 134 along the movable element moving direction. The fourth plate 136 is positioned in the movable element closing direction G with respect to the movable element 23 and extends from an end of the third plate 135 in parallel to the movable element 23.

The excitation portion of the first stator 13*a* configured by the first plate 133 to the fourth plate 136 has a winding shape, and therefore a magnetic field is generated around the excitation portion when a current flows in the excitation portion.

In the excitation portion of the first stator 13*a*, a direction of current flowing in the second plate 134 that is positioned in the movable element opening direction F with respect to the movable element 23 is opposite to a direction of current flowing in the movable element 23.

Furthermore, in the excitation portion of the first stator 13*a*, a direction of current flowing in the fourth plate 136 that is positioned in the movable element closing direction G with respect to the movable element 23 is the same as a direction of current flowing in the movable element 23.

The second plate 134 to the fourth plate 136 of the first stator 13*a*, and the movable element 23 are arranged in a positional relationship so as to be displaced from each other in the reference direction Z, and so as not to overlap with each other when viewed along the movable element moving direction.

In present embodiment, the density of the movable element passing magnetic flux becomes twice as large as those in the first and second embodiments, and therefore the total Lorentz force becomes also twice as large as those in the first and second embodiments. Thus, separation between the movable contacts 25 and the fixed contacts 14 due to the contact portion electromagnetic repulsive force can be further restricted.

Also, in present embodiment, because the movable element 23 is subjected to the Lorentz force from either side thereof, the posture of the movable element 23 is stabilized.

Fourth Embodiment

Figure 6A:
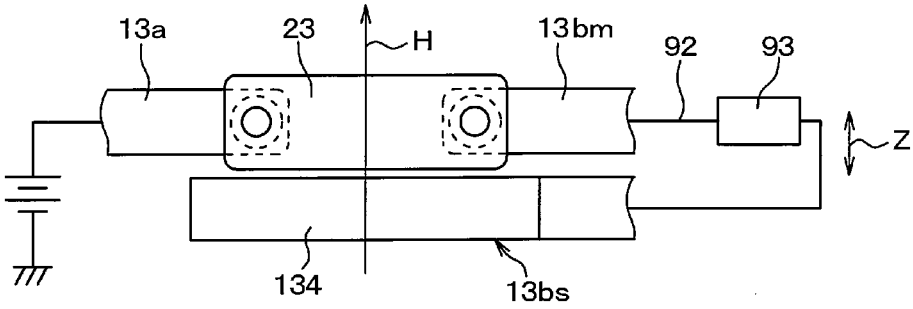
FIG. 6A is a plan view showing configurations of a movable element and stators in a relay, and an external electric circuit according to a fourth embodiment of the present disclosure.
Figure 6B:
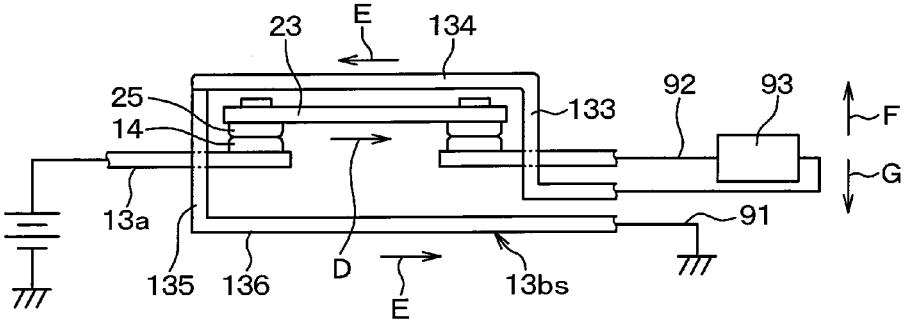
FIG. 6B is a front view showing the configurations of the movable element and the stators, and the external electric circuit in FIG. 6A.

A fourth embodiment of the present disclosure will be described. FIG. 6A is a plan view showing configurations of a movable element 23 and stators 13 in a relay, and an external electric circuit according to the fourth embodiment of the present disclosure, and FIG. 6B is a front view showing the configurations of the movable element 23 and the stators 13, and the external electric circuit in FIG. 6A. Hereinafter, only portions different from those in the first embodiment will be described.

As shown in FIG. 6A and FIG. 6B, the second stator 13*b* is divided into a second main stator 13*bm* and a second sub-stator 13*bs*. The second main stator 3*bm* has a slender rectangular parallel piped shape and has the fixed contact 14 at a position facing the movable contacts 25. The second sub-stator 13*bs* is grounded through an external harness 91.

The second main stator 13*bm* and the second sub-stator 13*bs* are electrically coupled to each other by an external harness 92. Also, an electric load 93 is arranged in the external harness 92.

The second sub-stator 13*bs* is arranged in a positional relationship so as to extend close to the movable element 23 and in parallel to the movable element 23 (that is, movable contact alignment direction), to be displaced from the movable element 23 in the reference direction Z, and so as not to overlap with the movable element 23 when viewed along the movable element moving direction.

The second sub-stator 13*bs* includes an excitation portion configured by the first plate 133 to the fourth plate 136 to generate the magnetic field. The excitation portion has a winding shape as explicitly shown in FIG. 6B, and therefore a magnetic field is generated around the excitation portion when a current flows in the excitation portion.

A direction of current flowing in the second plate 134 that is positioned in the movable element opening direction F with respect to the movable element 23 is opposite to a direction of current flowing in the movable element 23.

A direction of current flowing in the fourth plate 136 that is positioned in the movable element closing direction with respect to the movable element 23 is the same as a direction of current flowing in the movable element 23.

According to present embodiment, the magnetic flux of the magnetic field generated by the excitation portion of the second sub-stator 13*bs* passes through the movable element 23. The Lorentz force is generated by the movable element passing magnetic flux and the current flowing in the movable element 23. The Lorentz force causes the movable element 23 to be biased in a direction for bringing the movable contacts 25 into contact with the fixed contacts 14. Accordingly, as in the first embodiment, separation between the movable contacts 25 and the fixed contacts 14 due to the contact portion electromagnetic repulsive force can be restricted with certainty even during the large-current energization.

Furthermore, a position at which the load circuit terminal 131 (refer to FIG. 2) is extracted from the second main stator 13*bm* can be selected with a high degree of freedom.

Figure 7A:
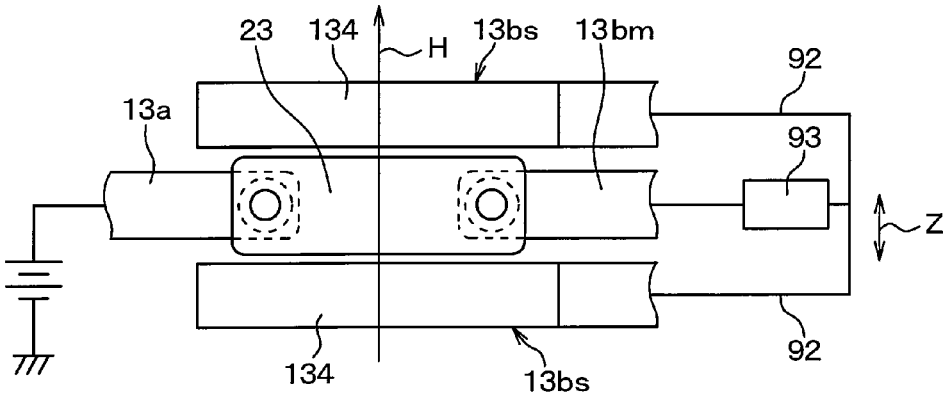
FIG. 7A is a plan view showing configurations of a movable element and stators, and an external electric circuit according to a modification of the fourth embodiment.
Figure 7B:
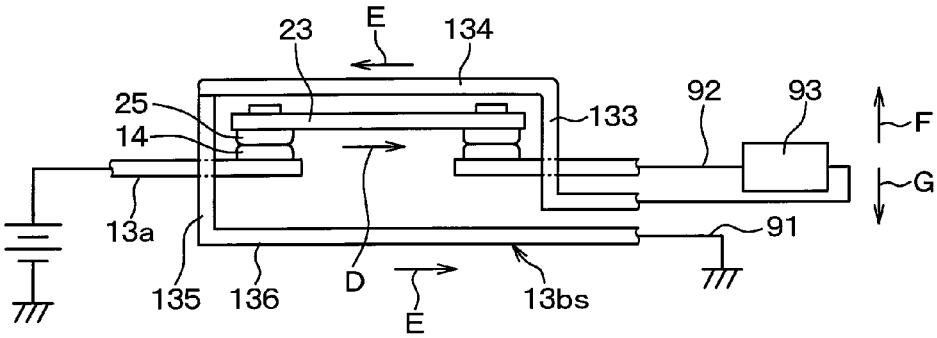
FIG. 7B is a front view showing the configurations of the movable element and the stators, and the external electric circuit in FIG. 7A.

FIG. 7A is a plan view showing configurations of a movable element 23 and stators 13, and an external electric circuit according to a modification of the fourth embodiment, and FIG. 7B is a front view showing the configurations of the movable element 23 and the stators 13 and the external electric circuit in FIG. 7A.

As in the modification shown in FIG. 7A and FIG. 7B, two of the second sub-stators 13*bs* may be provided so that those two second sub-stators 13*bs* may be located on either side of the movable element 23 when viewed along the movable element moving direction. With this arrangement, the movable element 23 is subjected to the Lorentz force from either side thereof, and therefore the posture of the movable element 23 is stabilized.

Fifth Embodiment

Figure 8C:
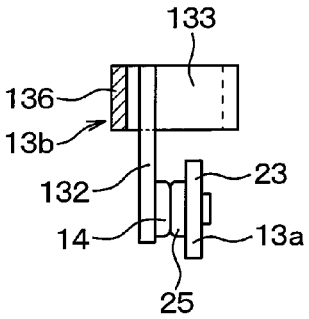
FIG. 8C is a fragmentary view of the movable element and the stators taken in the direction of an arrow K in FIG. 8A.
Figure 8A:
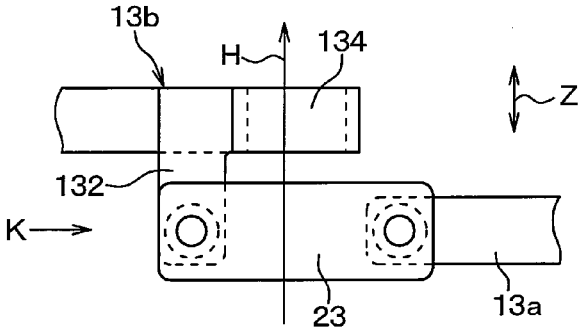
FIG. 8A is a plan view of a movable element and stators in a relay according to a fifth embodiment of the present disclosure.
Figure 8B:
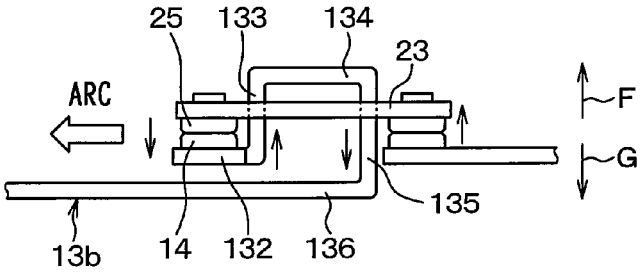
FIG. 8B is a front view of the movable element and the stators in FIG. 8A.

A fifth embodiment of the present disclosure will be described. FIG. 8A is a plan view of a movable element 23 and stators 13 in a relay according to the fifth embodiment of the present disclosure, FIG. 8B is a front view of the movable element 23 and the stators 13 in FIG. 8A, and FIG. 8C is a fragmentary view of the movable element 23 and the stators 13 taken in the direction of an arrow K in FIG. 8A. Hereinafter, only portions different from those in the first embodiment will be described.

As shown in FIG. 8A to FIG. 8C, the first plate 133 and the third plate 135 in the excitation portion are located inside of the movable contacts 25 and the fixed contacts 14 in the movable contact alignment direction.

The excitation portion has a winding shape as explicitly shown in FIG. 8B, and therefore a magnetic field is generated around the excitation portion when a current flows in the excitation portion.

A direction of current flowing in the second plate 134 that is located in the movable element opening direction F with respect to the movable element 23 is opposite to the direction of current flowing in the movable element 23.

A direction of current flowing in the fourth plate 136 that is located in the movable element closing direction with respect to the movable element 23 in the excitation portion is the same as the direction of current flowing in the movable element 23.

The second plate 134 to the fourth plate 136, and the movable element 23 are arranged in the positional relationship so as to be displaced from each other in the reference direction Z, and so as not to overlap with each other when viewed along the movable element moving direction.

According to present embodiment, the magnetic flux of the magnetic field generated by the excitation portion passes through the movable element 23. The Lorentz force is generated by the movable element passing magnetic flux and the current flowing in the movable element 23. The Lorentz force causes the movable element 23 to be biased in a direction for bringing the movable contacts 25 into contact with the fixed contacts 14. Therefore, as in the first embodiment, separation between the movable contacts 25 and the fixed contacts 14 due to the contact portion electromagnetic repulsive force can be restricted with certainty even during the large-current energization.

The directions of currents in the contact portions of the movable contacts 25 and the fixed contacts 14 are opposite to the respective directions of currents flowing in the first plate 133 or the third plate 135 each of which is disposed close to the contact portions. Therefore, arcs generated when the movable contacts 25 move away from the fixed contacts 14 extend in a direction of moving away from the first plate 133 or the third plate 135, and blocked by the Lorentz force generated by those currents.

Sixth Embodiment

Figure 9C:
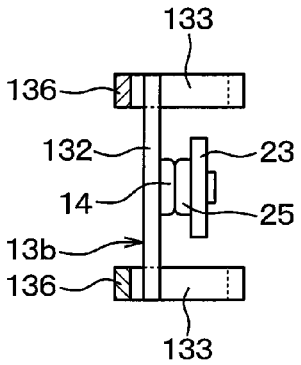
FIG. 9C is a fragmentary view of the movable element and the stators taken in the direction of an arrow L in FIG. 9A.
Figure 9A:
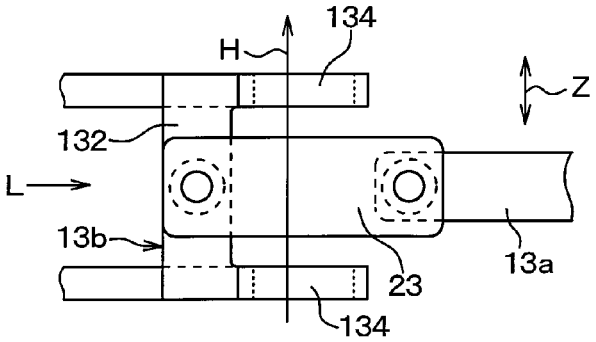
FIG. 9A is a plan view of a movable element and stators in a relay according to a sixth embodiment of the present disclosure.
Figure 9B:
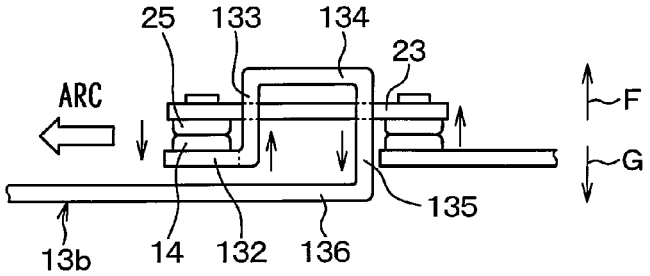
FIG. 9B is a front view of the movable element and the stators in FIG. 9A.

A sixth embodiment of the present disclosure will be described. FIG. 9A is a plan view of a movable element 23 and stators 13 in a relay according to the sixth embodiment of the present disclosure, FIG. 9B is a front view of the movable element 23 and the stators 13 in FIG. 9A, and FIG. 9C is a fragmentary view of the movable element 23 and the stators 13 taken in the direction of an arrow L in FIG. 9A. Hereinafter, only portions different from those in the fifth embodiment (refer to FIG. 8A to FIG. 8C) will be described.

As shown in FIG. 9A to FIG. 9C, the second stator 13*b* is divided into two pieces from one end of the fixed contact mounting plate 132, and provides two sets of the first plates 133 to the fourth plates 136. In other words, the second stator 13*b* has two excitation portions.

The two sets of the first plates 133 to the fourth plates 136 are arranged on either side of the movable element 23 when viewed along the movable element moving direction.

In present embodiment, because the movable element 23 is subjected to the Lorentz force from either side thereof, the posture of the movable element 23 is stabilized.

Furthermore, according to present embodiment, because the current flowing in the second stator 13*b* is divided into two by the two sets of the first plates 133 to the fourth plates 136, the respective cross-sectional areas of the first plates 133 to the fourth plates 136 can be reduced. Thus, a bending process in manufacturing the second stator 13*b* can be facilitated.

Seventh Embodiment

Figure 10C:
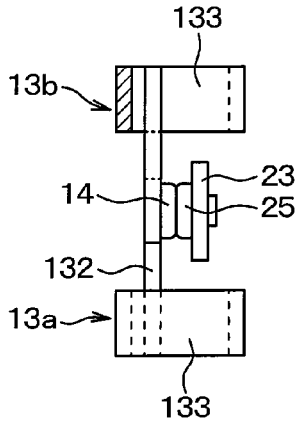
FIG. 10C is a fragmentary view of the movable element and the stators taken in the direction of an arrow M in FIG. 10A.
Figure 10A:
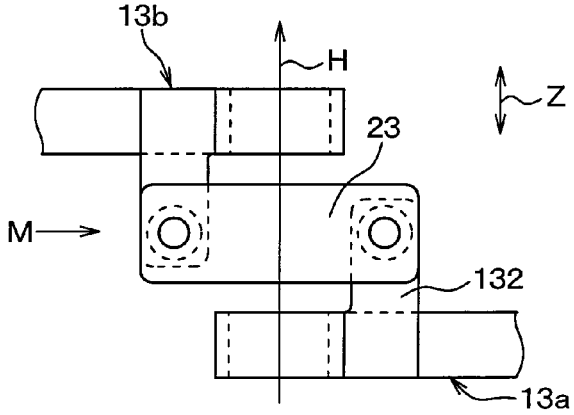
FIG. 10A is a plan view of a movable element and stators in a relay according to a seventh embodiment of the present disclosure.
Figure 10B:
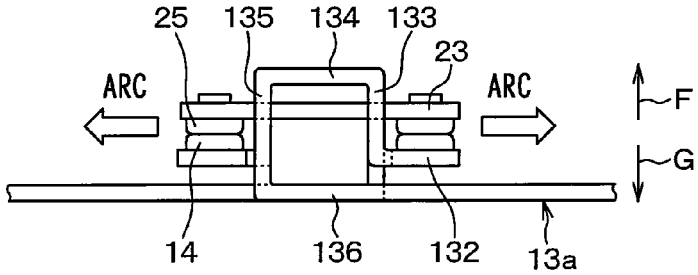
FIG. 10B is a front view of the movable element and the stators in FIG. 10A.

A seventh embodiment of the present disclosure will be described. FIG. 10A is a plan view of a movable element 23 and stators 13 in a relay according to the seventh embodiment of the present disclosure, FIG. 10B is a front view of the movable element 23 and the stators 13 in FIG. 10A, and FIG. 10C is a fragmentary view of the movable element 23 and the stators 13 taken in the direction of an arrow M in FIG. 10A. Hereinafter, only portions different from those in the fifth embodiment (refer to FIG. 8) will be described.

As shown in FIG. 10A to FIG. 100, the first stator 13*a* also has the same shape as that of the second stator 13*b* in the fifth embodiment.

That is, the first stator 13*a* includes the fixed contact mounting plates 132 on which the fixed contact 14 is fixed. The fixed contact mounting plates 132 is positioned in the movable element closing direction G with respect to the movable element 23. In other words, the fixed contact mounting plates 132 is located on an opposite side of the movable contact 25 from the movable element 23.

The first stator 13*a* includes the excitation portion that generates a magnetic field. The excitation portion includes the first plate 133, the second plate 134, the third plate 135, and the fourth plate 136. The first plate 133 extends from the end of the fixed contact mounting plate 132 along the movable element moving direction. The second plate 134 is positioned in the movable element opening direction F with respect to the movable element 23, and extends from the end of the first plate 133 in parallel to the movable element 23. The third plate 135 extends from the end of the second plate 134 along the movable element moving direction. The fourth plate 136 is positioned in the movable element closing direction G with respect to the movable element 23, and extends from the end of the third plate 135 in parallel to the movable element 23. The first plate 133 and the third plate 135 are located inside of the movable contacts 25 and the fixed contacts 14 in the movable contact alignment direction.

The excitation portion of the first stator 13*a* configured by the first plate 133 to the fourth plate 136 has a winding shape, and therefore a magnetic field is generated around the excitation portion when a current flows in the excitation portion.

In the excitation portion of the first stator 13*a*, the direction of current flowing in the second plate 134 that is positioned in the movable element opening direction F with respect to the movable element 23 is opposite to the direction of current flowing in the movable element 23.

Furthermore, in the excitation portion of the first stator 13*a*, the direction of current flowing in the fourth plate 136 that is positioned in the movable element closing direction G with respect to the movable element 23 is the same as the direction of current flowing in the movable element 23.

The second plate 134 to the fourth plate 136 of the first stator 13*a*, and the movable element 23 are arranged in a positional relationship so as to be displaced from each other in the reference direction Z, and so as not to overlap with each other when viewed along the movable element moving direction.

In present embodiment, the density of the movable element passing magnetic flux becomes twice as large as that in the fifth embodiment, and therefore the total Lorentz force becomes also twice as large as that in the fifth embodiment. Accordingly, separation between the movable contacts 25 and the fixed contacts 14 due to the contact portion electromagnetic repulsive force can be further restricted.

Also, in present embodiment, the movable element 23 is subjected to the Lorentz force from either side thereof, and therefore the posture of the movable element 23 is stabilized.

Further, in fifth embodiment, the arcs generated when the movable contacts 25 moves away from the fixed contacts 14 are subjected to the Lorentz force generated by the current flowing in the contact portion of the movable contacts 25 and the fixed contacts 14 and the current flowing in the second stator 13*b*. On the other hand, in present embodiment, the arcs are also subjected to the Lorentz force generated by the current flowing in the contact portion of the movable contacts 25 and the fixed contacts 14 and the current flowing in the first stator 13*a*. As a result, the arcs can be blocked more certainly.

Eighth Embodiment

Figure 11:
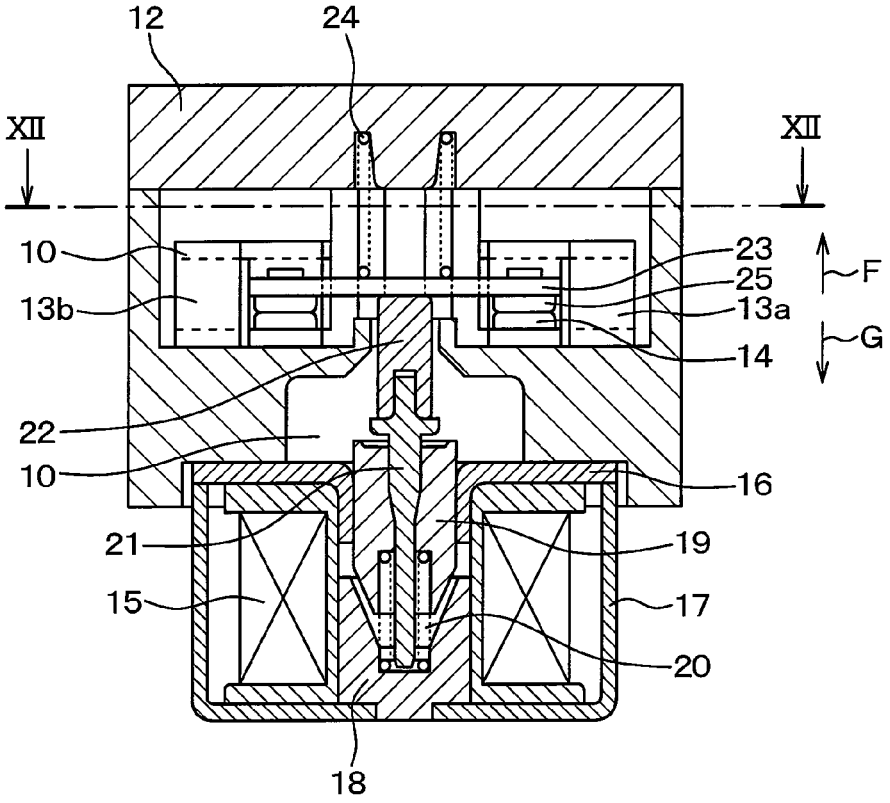
FIG. 11 is a cross-sectional view showing a relay according to an eighth embodiment of the present disclosure.
Figure 12:
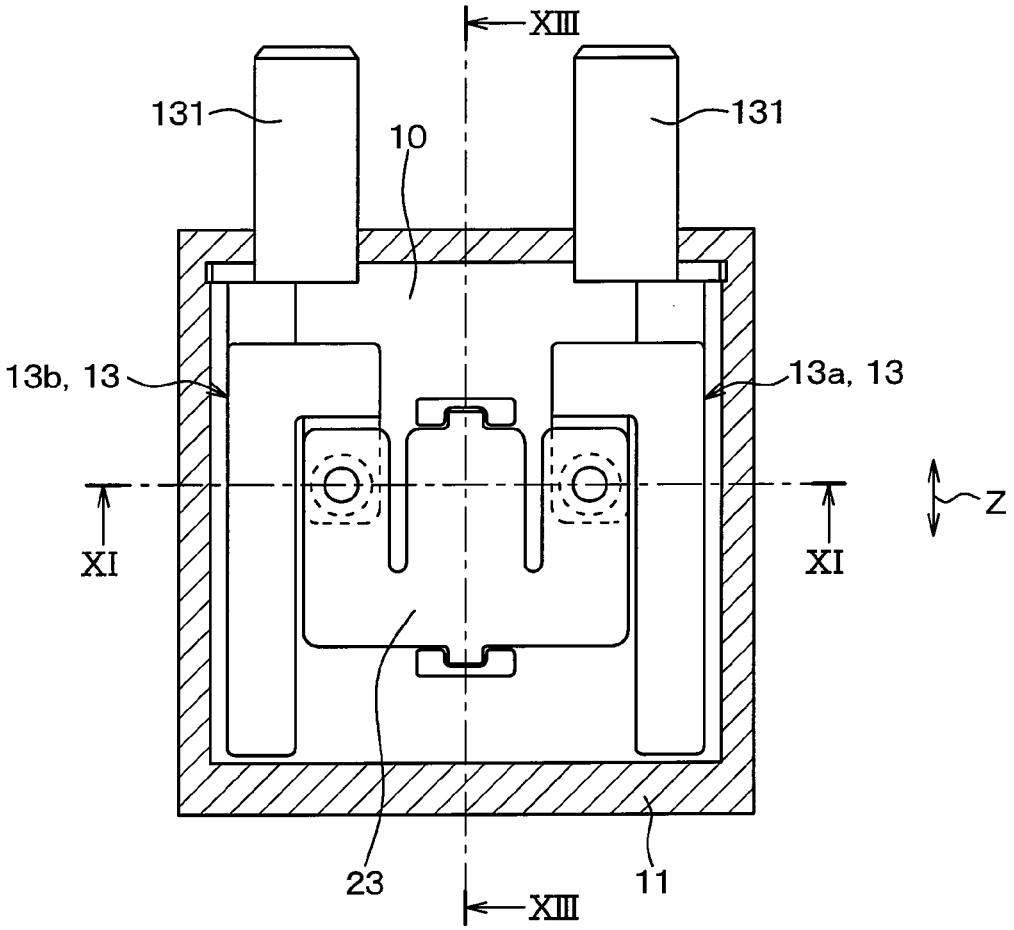
FIG. 12 is a cross-sectional view of the relay taken along a line XII-XII in FIG. 11.
Figure 13:
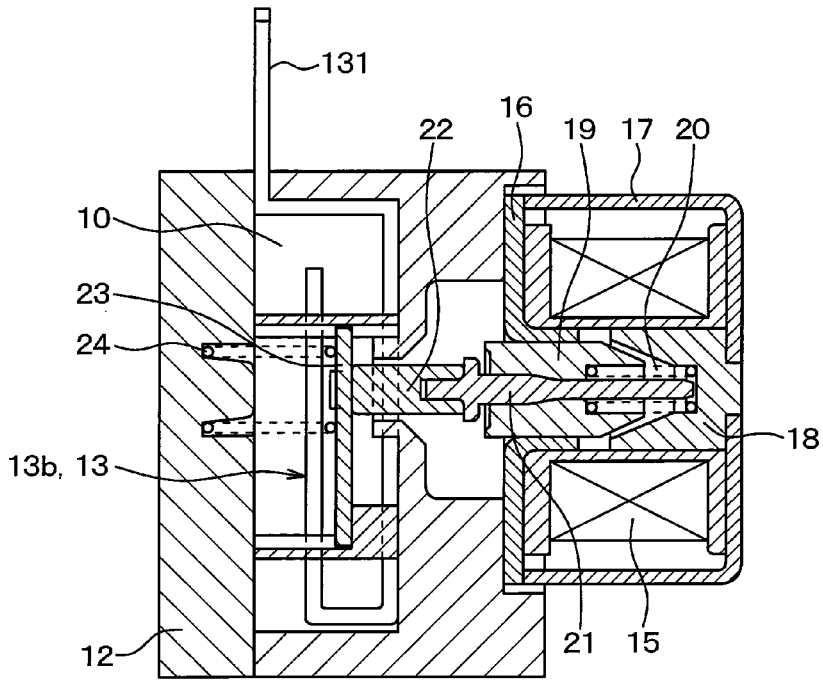
FIG. 13 is a cross-sectional view of the relay taken along a line XIII-XIII in FIG. 12.
Figure 14A:
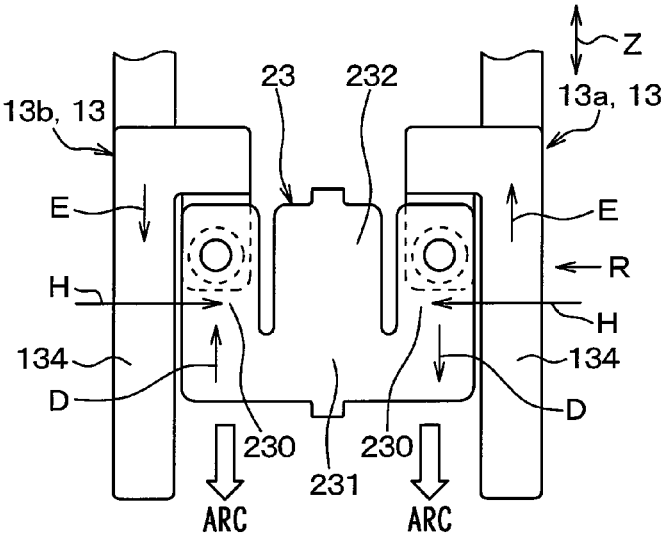
FIG. 14A is a plan view of a movable element and stators in a relay in FIG. 11.
Figure 14C:
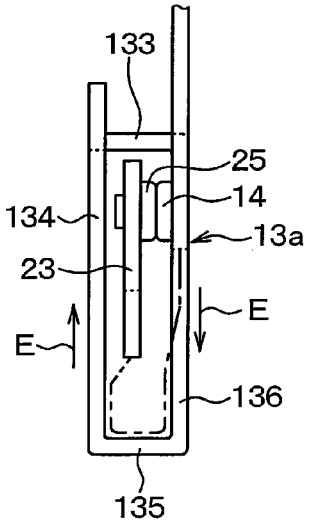
FIG. 14C is a fragmentary view of the movable element and the stators taken in the direction of an arrow R in FIG. 14A.
Figure 14B:
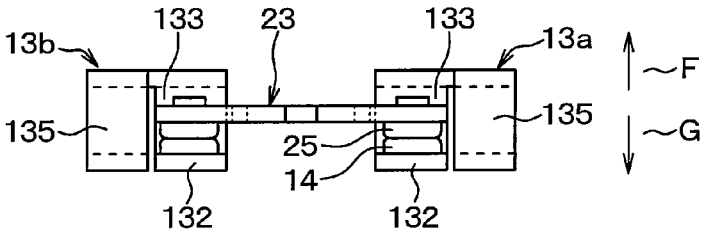
FIG. 14B is a front view of the movable element and the stators in FIG. 14A.

An eighth embodiment of the present disclosure will be described. FIG. 11 is a cross-sectional view showing a relay according to the eighth embodiment of the present disclosure, which corresponds to a cross-sectional view taken along a line XI-XI in FIG. 12. FIG. 12 is a cross-sectional view of the relay taken along a line XII-XII in FIG. 11. FIG. 13 is a cross-sectional view of the relay taken along a line XIII-XIII in FIG. 12. FIG. 14A is a plan view of the movable element 23 and the stators 13 in the relay in FIG. 11, FIG. 14B is a front view of the movable element 23 and the stators 13 in FIG. 14A, and FIG. 14C is a fragmentary view of the movable element 23 and the stators 13 taken in the direction of an arrow R in FIG. 14A. Hereinafter, only portions different from those in the first embodiment will be described.

As shown in FIG. 11 to FIG. 14C, the movable element 23 includes two movable contact mounting plates 230 on which the respective movable contacts 25 are fixed, a coupling plate 231 that couples those two movable contact mounting plates 230 with each other, and one spring bearing plate 232 that bears the contact pressure spring 24.

Those two movable contact mounting plates 230 extend in parallel to the reference direction Z, are fixed with the respective movable contacts 25 on one end thereof in the extending direction, and are coupled to each other by the coupling plate 231 on the other end thereof in the extending direction.

The spring bearing plate 232 is located between the two movable contact mounting plates 230, protrudes from an intermediate portion of the coupling plate 231 in the longitudinal direction thereof, and extends in the reference direction Z.

The shape of the movable element 23 when viewed in the planar view is linearly symmetric with respect to a line XIII-XIII. Also, the shapes of the first stator 13*a* and the second stator 13*b* when viewed in the plan view, which will be described in detail below, are linearly symmetric with respect to the line XIII-XIII.

The first stator 13*a* and the second stator 13*b* each include the fixed contact mounting plate 132 on which the stator 13 is fixed. The fixed contact mounting plate 132 is located in the movable element closing direction G with respect to the movable element 23. In other words, the fixed contact mounting plate 132 is located on an opposite side of the movable contact 25 from the movable element 23.

Also, the first stator 13*a* and the second stator 13*b* each include the excitation portion that generates the magnetic field. The excitation portion includes the first plate 133, the second plate 134, the third plate 135, and the fourth plate 136. The first plate 133 extends from the end of the fixed contact mounting plate 132 along the movable element moving direction. The second plate 134 is positioned in the movable element opening direction F with respect to the movable element 23. In other words, the second plate 134 is located to an opposite side of the movable element 23 from the movable contact 25. The second plate 134 is disposed adjacent to the movable contact mounting plate 230, and extends from the end of the first plate 133 in parallel to the movable contact mounting plate 230 (that is, movable contact alignment direction). The third plate 135 extends from the end of the second plate 134 along the movable element moving direction. The fourth plate 136 is positioned in the movable element closing direction G with respect to the movable element 23. The fourth plate 136 is disposed adjacent to the movable contact mounting plates 230 and extends from the end of the third plate 135 in parallel to the movable contact mounting plates 230.

The excitation portion of the first stator 13*a* configured by the first plate 133 to the fourth plate 136, and the excitation portion of the second stator 13*b* configured by the first plate 133 to the fourth plate 136 are located on either side of the movable element 23 in the movable contact alignment direction so that the movable element 23 is disposed between the excitation portion of the first stator 13*a* and the excitation portion of the second stator 13*b*.

Each of those excitation portions has a winding shape as explicitly shown in FIG. 14C, and therefore a magnetic field is generated around the excitation portion when a current flows in the excitation portion.

A direction of current flowing in the second plate 134 that is positioned in the movable element opening direction F with respect to the movable element 23 is opposite to the direction of current flowing in the movable contact mounting plates 230.

Furthermore, a direction of current flowing in the fourth plate 136 that is positioned in the movable element closing direction G with respect to the movable element 23 is the same as the direction of current flowing in the movable contact mounting plates 230.

The second plate 134 to the fourth plate 136, and the movable element 23 are arranged in the positional relationship so as to be displaced from each other in the movable contact alignment direction, and so as not to overlap with each other when viewed along the movable element moving direction.

In present embodiment, the density of the movable element passing magnetic flux becomes twice as large as that in the first embodiment, and therefore the total Lorentz force becomes also twice as large as that in the first embodiment. Accordingly, separation between the movable contacts 25 and the fixed contacts 14 due to the contact portion electromagnetic repulsive force can be further restricted.

Also, in present embodiment, the movable element 23 is subjected to the Lorentz force from either thereof, and therefore the posture of the movable element 23 is stabilized.

Further, when the movable contacts 25 move away from the fixed contacts 14, each arc is generated like a line connecting the end of the fixed contact mounting plate 132 (lower end on paper plane in FIG. 14C) and the end of the movable contact mounting plate 230 (lower end on paper plane in FIG. 14C). Thereafter, the arc is extended by the magnetic field generated by the excitation portion so as to be shaped along the excitation portion as indicated by a dashed line in FIG. 14C. In present embodiment, because the excitation is sufficiently longer than the fixed contact mounting plate 132, the arc can be elongated, and the arc can be blocked with certainty.

Figure 15A:
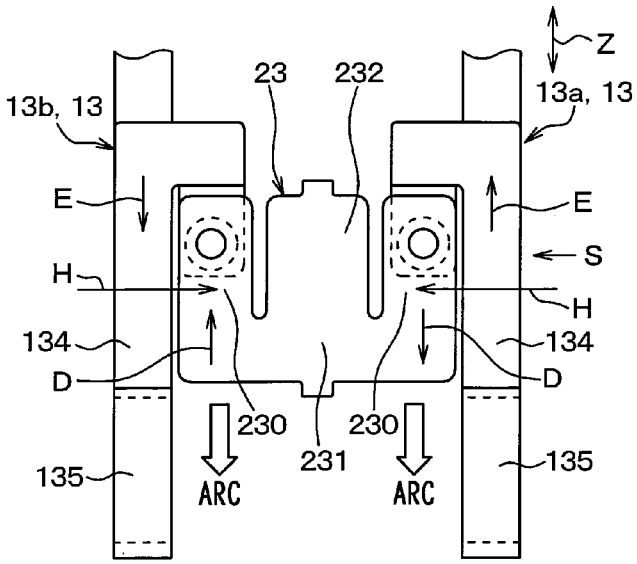
FIG. 15A is a plan view showing configurations of a movable element and stators according to a modification of the eighth embodiment.
Figure 15C:
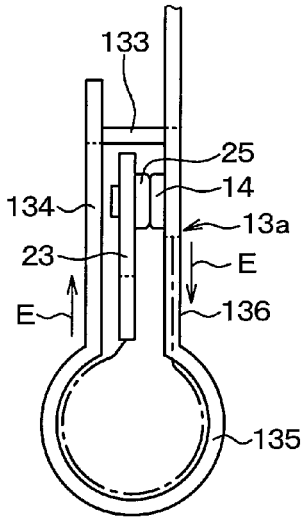
FIG. 15C is a fragmentary view of the movable element and the stators taken in the direction of an arrow S in FIG. 15A.
Figure 15B:
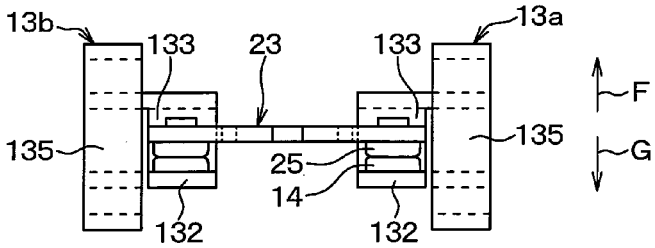
FIG. 15B is a front view showing the configurations of the movable element and the stators in FIG. 15A.

FIG. 15A is a plan view showing configurations of a movable element 23 and stators 13 according to a modification of the eighth embodiment, FIG. 15B is a front view showing the configurations of the movable element 23 and the stators 13 in FIG. 15A, and FIG. 15C is a fragmentary view of the movable element 23 and the stators 13 taken in the direction of an arrow S in FIG. 15A.

As shown in the modification in FIG. 15A to FIG. 15C, the third plate 135 of the excitation portion may be shaped into an arc. In this case, the arc generated when the movable contact 25 moves away from the fixed contact 14 is elongated into a shape along the excitation portion as indicated by the dashed line in FIG. 15C, and blocked.

As in this modification, the third plate 135 is shaped into the arc with the results that the arc can be more elongated without any increase in a length of the excitation portion in the reference direction Z, and the arc can be blocked more certainly.

Other Embodiments

In the above respective embodiments, the movable core 19 is attracted toward the fixed core 18 by the electromagnetic force of the coil 15. Alternatively, the movable core 19 may be driven toward the fixed core 18 by driving means other than the coil 15.

Also, in the above respective embodiments, the fixed contacts 14 of different members are fixed by swaging on the respective stators 13. Alternatively, a protrusion may be formed on each of the stators 13, for example, by a press work so as to protrude toward the movable element 23, and the protrusion may function as the fixed contact.

Likewise, in the above respective embodiments, the movable contacts 25 of different members are fixed by swaging on the movable element 23. Alternatively, protrusions may be formed on the movable element 23, for example, by a press work so as to protrude toward the stators 13, and the protrusions may function as the movable contact.

Further, the three fixed contacts 14 and the three movable contacts 25 are provided, and the fixed contacts 14 and the movable contacts 25 are arranged so that a line connecting the three fixed contacts 14 and a line connecting the three movable contacts 25 each form a triangle when viewed along the movable element moving direction. According to this configuration, because three contact contacted portions are provided, the vibration of the movable element 23 is restricted, and furthermore abnormal noise and the consumption of the contacts, which are caused by the vibration of the movable element 23, are restricted.

The above respective embodiments can be arbitrarily combined together within a practicable range.

What is claimed is:

1. A relay comprising:

two stators each having a fixed contact, each of the stators including an excitation portion that has a winding shape and generates a magnetic field; and a movable element having movable contacts arranged in a movable contact alignment direction, the movable element including movable contact mounting plates on which the movable contacts are respectively fixed, the movable element being movable in a movable element moving direction including a movable element closing direction and a moving element opening direction, the movable contacts respectively coming in contact with the fixed contacts to close an electric circuit when the movable element moves in the movable element closing direction, and the movable contacts separating from the fixed contacts to open the electric circuit when the movable element moves in the movable element opening direction, the movable contact mounting plates extending along a reference direction that is perpendicular to the movable contact alignment direction and the movable element moving direction, wherein in a magnetic flux of the magnetic field generated by the excitation portion, a movable element passing magnetic flux that passes through the movable element is orthogonal to a direction of current flowing in the movable element and the movable element moving direction, a Lorentz force that is generated by the movable element passing magnetic flux and the current flowing in the movable element acts in a direction for bringing the movable contacts into contact with the fixed contacts, each of the stators further includes a fixed contact mounting plate on which the fixed contact is disposed, and the fixed contact mounting plate is positioned in the movable element closing direction with respect to the movable element, the excitation portion in each of the stators includes a first plate, a second plate, a third plate, and a fourth plate, the first plate extends from an end of the fixed contact mounting plate along the movable element moving direction, the second plate is positioned in the movable element opening direction with respect to the movable element, is disposed adjacent to the movable contact mounting plate, and extends from an end of the first plate along the reference direction, the third plate extends from an end of the second plate along the movable element moving direction, the fourth plate is positioned in the movable element closing direction with respect to the movable element and extends from an end of the third plate along the reference direction, and the movable element is disposed between the excitation portions of the two stators in the movable contact alignment direction.

2. The relay according to claim 1, wherein, in the moving direction of the movable element, a direction for separating the movable contacts from the fixed contacts is referred to as a movable element opening direction, and a direction for bringing the movable contacts into contact with the fixed contacts is referred to as a movable element closing direction, wherein a direction of current flowing in a region in the excitation portion positioned in the movable element opening direction with respect to the movable element is opposite to the direction of current flowing in the movable element, and wherein a direction of current flowing in a region in the excitation portion positioned in the movable element closing direction with respect to the movable element is the same as the direction of current flowing in the movable element.

3. The relay according to claim 1, wherein, in the moving direction of the movable element, a direction for separating the movable contacts from the fixed contacts is referred to as a movable element opening region, and wherein the movable element and a region in the excitation portion positioned in the movable element closing direction with respect to the movable element are disposed so as not to overlap with each other when viewed along the moving direction of the movable element.

4. The relay according to claim 1, wherein the excitation portion is disposed on either side of the movable element when viewed along the moving direction of the movable element.

5. The relay according to claim 1, further comprising a magnet disposed adjacent to the movable element, wherein a Lorentz force generated by the current flowing in the movable element and a magnetic flux of the magnet acts in a direction for bringing the movable contacts into contact with the fixed contacts.

6. The relay according to claim 1, further comprising:

a coil generating an electromagnetic force during energization;

a movable member attracted by the electromagnetic force of the coil; and a contact pressure spring biasing the movable element in a direction for bringing the movable contacts into contact with the fixed contacts, wherein when the movable member is attracted by the electromagnetic force of the coil, the movable member moves away from the movable element, and the movable element is biased by the contact pressure spring so that the movable contacts come into contact with the fixed contacts.

* * * * *

UNITED STATES PATENT AND TRADEMARK OFFICE

CERTIFICATE OF CORRECTION

PATENT NO. : 8,847,714 B2
APPLICATION NO. : 14/050541
DATED : September 30, 2014
INVENTOR(S) : Akikazu Uchida It is certified that error appears in the above-identified patent and that said Letters Patent is hereby corrected as shown below:

Correct assignee in item (73) on the title page of the patent to read as follows:

Anden Co., Ltd.

Signed and Sealed this
Sixteenth Day of December, 2014

Michelle K. Lee

Michelle K. Lee
*Deputy Director of the United States Patent and Trademark Office*